US007234852B2

(12) United States Patent
Nishizawa et al.

(10) Patent No.: US 7,234,852 B2
(45) Date of Patent: Jun. 26, 2007

(54) VEHICLE HEADLAMP

(75) Inventors: Takaaki Nishizawa, Shizuoka (JP); Hiroki Ikegaya, Shizuoka (JP); Masahito Naganawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 68 days.

(21) Appl. No.: 11/118,391

(22) Filed: May 2, 2005

(65) Prior Publication Data

US 2005/0248955 A1 Nov. 10, 2005

(30) Foreign Application Priority Data

May 7, 2004 (JP) ..... P.2004-138276

(51) Int. Cl.
*F21V 7/00* (2006.01)

(52) U.S. Cl. ..... 362/517; 362/522; 362/346

(58) Field of Classification Search ..... 362/539, 362/538, 298, 299, 303, 300, 520, 521, 516, 362/517, 346, 522, 518, 328, 351, 297
See application file for complete search history.

(56) References Cited

U.S. PATENT DOCUMENTS 4,949,226 A * 8/1990 Makita et al. ..... 362/538
5,070,432 A * 12/1991 Kitazumi et al. ..... 362/538
5,938,323 A * 8/1999 McMahan ..... 362/539
6,050,705 A * 4/2000 Kusserow et al. ..... 362/299
6,155,702 A * 12/2000 Blusseau et al. ..... 362/520
6,454,448 B2 * 9/2002 Taniuchi et al. ..... 362/517
6,910,792 B2 * 6/2005 Takada et al. ..... 362/539

FOREIGN PATENT DOCUMENTS

JP 4-39137 A 2/1992
JP 2001-76510 A 3/2001

* cited by examiner

*Primary Examiner*—Renee Luebke
*Assistant Examiner*—Gunyoung T. Lee
(74) *Attorney, Agent, or Firm*—Sughrue Mion, PLLC

(57) ABSTRACT

A lamp includes a projection lens, a reflector, and a prismatic lens. The prismatic lens receives direct light, which has been transmitted from the light source outwardly with respect to a widthwise direction of a vehicle, and refracts the received light toward the optical axis. The prismatic lens is separated outwardly from the optical axis in the widthwise direction of a vehicle and is provided between the projection lens and the reflector. The prismatic lens can provide an additional light distribution pattern formed outside, in the widthwise orientation, of a basic light distribution pattern formed from light passed though the projection lens.

18 Claims, 9 Drawing Sheets

VEHICLE HEADLAMP

The present application claims foreign priority based on Japanese Patent Application No. 2004-138276, filed on May 12, 2004, the contents of which is incorporated by reference in its entirety. This priority claim is being made concurrently with the filing of the application.

BACKGROUND OF THE INVENTION

1. Technical Field

The present invention relates to a projector-type vehicle headlamp, and particularly to a vehicle headlamp configured to illuminate light for forming a low-beam light distribution pattern.

2. Background

A vehicle headlamp is generally configured such that a projection lens is disposed on an optical axis extending in a longitudinal direction of a vehicle, a light source is disposed to the rear of a rear focal point of the projection lens, and light from the light source is reflected close to the optical axis by a reflector.

Japanese Patent Publication JP-A-2001-76510 discloses a lamp configuration wherein a shade for shielding a portion of light reflected by the reflector is disposed in the vicinity of a rear focal point of the projection lens.

In addition, Japanese Patent Publication JP-A-4-39137 discloses a lamp configuration with an annular prismatic lens for refracting direct light that has traveled from the light source toward the outside in the widthwise direction of the vehicle, to approach an optical axis. The lens is disposed between the projection lens and the reflector.

When the lamp configuration disclosed in Japanese Patent Publication JP-A-2001-76510 is employed, light for forming a low-beam light distribution pattern can be illuminated. However, the luminous energy of light illuminated forward of the vehicle is reduced by the quantity of light shielded by the shade.

When this lamp includes the annular translucent member as disclosed in Japanese Patent Publication JP-A-4-39137, the direct light from the light source toward the space beyond the outer periphery of the projection lens illuminates forward of the lamp, thereby enabling effective utilization of light source luminous flux. Accordingly, the luminous energy of light illuminated forward of the vehicle can be increased.

However, the prismatic lens disclosed in Japanese Patent Publication JP-A-4-39137 has an annular shape. Accordingly, light that has exited from the prismatic lens cannot be controlled with high accuracy. Furthermore, a portion of the exited light becomes upward-illuminating light, thereby hindering formation of the low-beam light distribution pattern, which is problematic.

SUMMARY OF THE INVENTION

The present invention has been conceived in view of the above background, and aims at providing a projector-type vehicle headlamp configured to form a low-beam light distribution pattern and capable of increasing luminous energy of a low-beam light distribution pattern without hindering formation of the pattern. However, the present invention need not achieve this object, nor any other object, and further, may achieve other objects not disclosed herein.

The present invention provides a configuration of the prismatic lens and adopts a configuration in which an additional reflector is included.

A headlamp configured to illuminate light for forming a low-beam light distribution pattern, comprising a projection lens disposed on an optical axis extending in a longitudinal direction of a vehicle and having a rear focal point, a light source disposed rear of the rear focal point, and a first reflector that reflects light from the light source forward and substantially close to the optical axis. The headlamp also includes a shade disposed near the rear focal point such that an upper edge of the shade is near the optical axis, and shields a portion of light reflected by the reflector, as well as a prismatic lens that refracts direct light from the light source toward an outside of a widthwise direction of a vehicle, to approach the optical axis is disposed at a position outwardly separated from the optical axis in the widthwise direction of a vehicle between the projection lens and the reflector. Additionally, the headlamp includes a second reflector that reflects direct light from the light source toward an inside of the widthwise direction and toward the prismatic lens, and disposed at a position inwardly separated from the optical axis in the widthwise direction of the vehicle between the projection lens and the reflector.

Also provided is a lamp having an optical axis extending in a first direction, including a lamp body and a cover disposed at an opening of the lamp body to form a lamp chamber therein, and a lamp unit positioned in the lamp body. The lamp unit has a first reflector having a reflection surface that reflects light from a light source forward toward the optical axis, a lens holder extending forward from an opening of the reflector in a substantially cylindrical and tapered shape, and a projection lens having a substantially convex front and a substantially planar back surface, and disposed on the optical axis and to the rear of a rear focal point of the projection lens. The lamp holder further includes a shade integral with the lens holder at a substantially lower half section of an interior space of the lens holder, a prismatic lens attached to a substantially rectangular opening in an outside of an circumferential wall of the lens holder in a widthwise orientation, and a second reflector inside the circumferential wall of the lens holder in the widthwise orientation. The reflection surface reflects direct light from the light source toward the prismatic lens as substantially parallel light.

No limitation is imposed on the type of a light source bulb. For instance, a discharge bulb, a halogen bulb, or the like, can be employed.

No limitation is imposed on a specific configuration, such as size or surface shape, of the prismatic lens, so long as the prismatic lens is disposed at a position outwardly separated from the optical axis in the widthwise direction of the vehicle between the projection lens and the reflector, and is configured to refract the direct light, which has traveled from the light source toward outside in the widthwise direction of the vehicle, so as to become closer to the optical axis. The term "prismatic lens" referred to here means an optical member having a function of optical deflection; and may be either a prism having only a function of optical deflection, or a lens having a function of optical diffusion in addition to that of optical deflection. The "position" where the prismatic lens is disposed is not limited to a specific location, so long as light having exited from the prismatic lens can be illuminated forward without allowing the light to pass through the projection lens. However, the position is preferably set to a location where the light, which has originated from the light source and has been reflected by the reflector, is not shielded.

No particular limitation is imposed on a specific configuration, such as size or reflection surface shape, of the additional reflector, so long as the additional reflector is disposed at a position inwardly separated from the optical axis in the widthwise direction of the vehicle between the projection lens and the reflector, and is configured so as to reflect toward the prismatic lens the direct light which has traveled from the light source toward inside in the widthwise direction of the vehicle. In addition, the "position" where the additional reflector is disposed is not limited to a specific location. However, the position is preferably set to a location where the light, which has originated from the light source and has been reflected by the reflector, is not shielded.

As described in the above configuration, the vehicle headlamp according to the invention is configured so that the reflector reflects light from the light source which is disposed to the rear of the rear focal point of the projection lens forward and close to the optical axis, and a portion of light reflected by the reflector is shielded by the shaded is posed in the vicinity of the rear focal point. Accordingly, a basic light distribution pattern that serves as a low-beam light distribution pattern can be formed from the light that originated from the light source, has been reflected by the reflector, and has passed through the projection lens.

In relation to the above, a prismatic lens for refracting light, which has traveled from the light source toward outside in the widthwise direction of the vehicle, so as to become closer to the optical axis without allowing the light to pass through the projection lens is disposed at a position outwardly separated from the optical axis in the widthwise direction of the vehicle between the projection lens and the reflector. Therefore, from light having exited from the prismatic lens, an additional light distribution pattern can be formed outside in the widthwise direction of the vehicle of the basic light distribution pattern which is formed from the light that has originated from the light source, has been reflected by the reflector, and has passed through the projection lens.

In addition, an additional reflector for reflecting the direct light, which has traveled from the light source toward inside in the widthwise direction of the vehicle, toward the prismatic lens is disposed at a position inwardly separated from the optical axis in the widthwise direction of the vehicle between the projection lens and the reflector. Accordingly, a second additional light distribution pattern can be formed from the light that has-originated from the light source, has been reflected by the additional reflector, and has passed through the prismatic lens. In relation to the above, the light reflected by the additional reflector and oriented toward the prismatic lens has a larger divergence angle—opened outward in the widthwise direction of the vehicle—in relation to the optical axis. Consequently, the second additional light distribution pattern is formed outside of the additional light distribution pattern in the widthwise direction of the vehicle.

By forming the additional light distribution pattern and the second additional light distribution pattern in addition to the basic light distribution pattern, luminous energy of the low-beam light distribution pattern can be increased.

In addition, the additional light distribution pattern is formed outside of the basic light distribution pattern with respect to the width wise direction of the vehicle, and the second additional light distribution pattern is formed outside of the additional light distribution pattern in the same direction. As a result, forward visibility at the time of vehicle cornering and the like can be enhanced without causing a driver of an oncoming vehicle or others to experience glare.

As described above, the present invention provides a projector-type vehicle headlamp configured to form a low-beam light distribution pattern capable of increasing luminous energy of a low-beam light distribution pattern without hindering formation of the pattern.

In the above configuration, when the prismatic lens is constituted of a plurality of lens elements, light deflection control can be performed with high accuracy while maintaining the thickness of the prismatic lens substantially uniform.

In the above configuration, when the prismatic lens is disposed below the optical axis and the additional reflector is disposed above the optical axis, upward-illuminating light can be prevented from exiting from the prismatic lens without controlling vertical optical deflection by the prismatic lens, to thus protect a driver of an oncoming vehicle or others from experiencing glare. As a result, the configuration of the prismatic lens can be simplified.

Furthermore, when the above configuration is further configured such that the projection lens is fixed to the reflector by way of a substantially cylindrical lens holder, such that the prismatic lens is attached to an opening formed in a circumferential wall of the lens holder, and such that the additional reflector is configured as a portion of the lens holder, positional accuracy of the prismatic lens and the additional reflector can be enhanced, and the lamp configuration can be simplified.

In the above configuration, when a second additional reflector for reflecting the direct light from the light source toward the additional reflector is disposed, a third additional light distribution pattern can be formed in addition to the additional light distribution pattern and the second additional light distribution pattern. Accordingly, luminous energy of the low-beam light distribution pattern can be further increased. Meanwhile, the second additional reflector may be configured either integrally with the reflector or independently.

DETAILED DESCRIPTION OF THE EMBODIMENTS

Embodiments of the invention will be described below by reference to the drawings. The lamp may be used in a vehicle, but the embodiments are not limited thereto.

Figure 1:
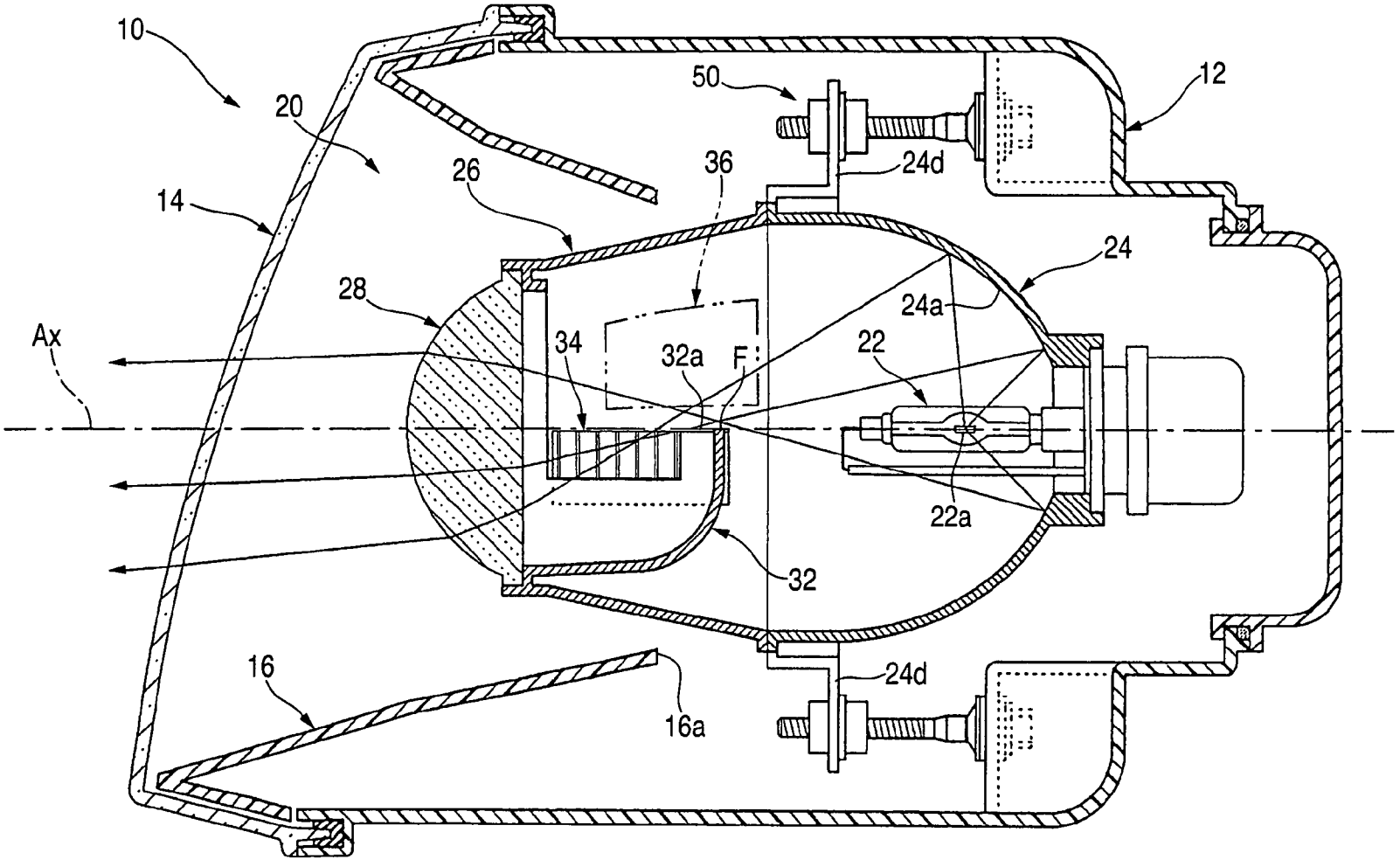
FIG. 1 is a side cross-sectional view showing a vehicle headlamp according to an exemplary, non-limiting embodiment.
Figure 2:
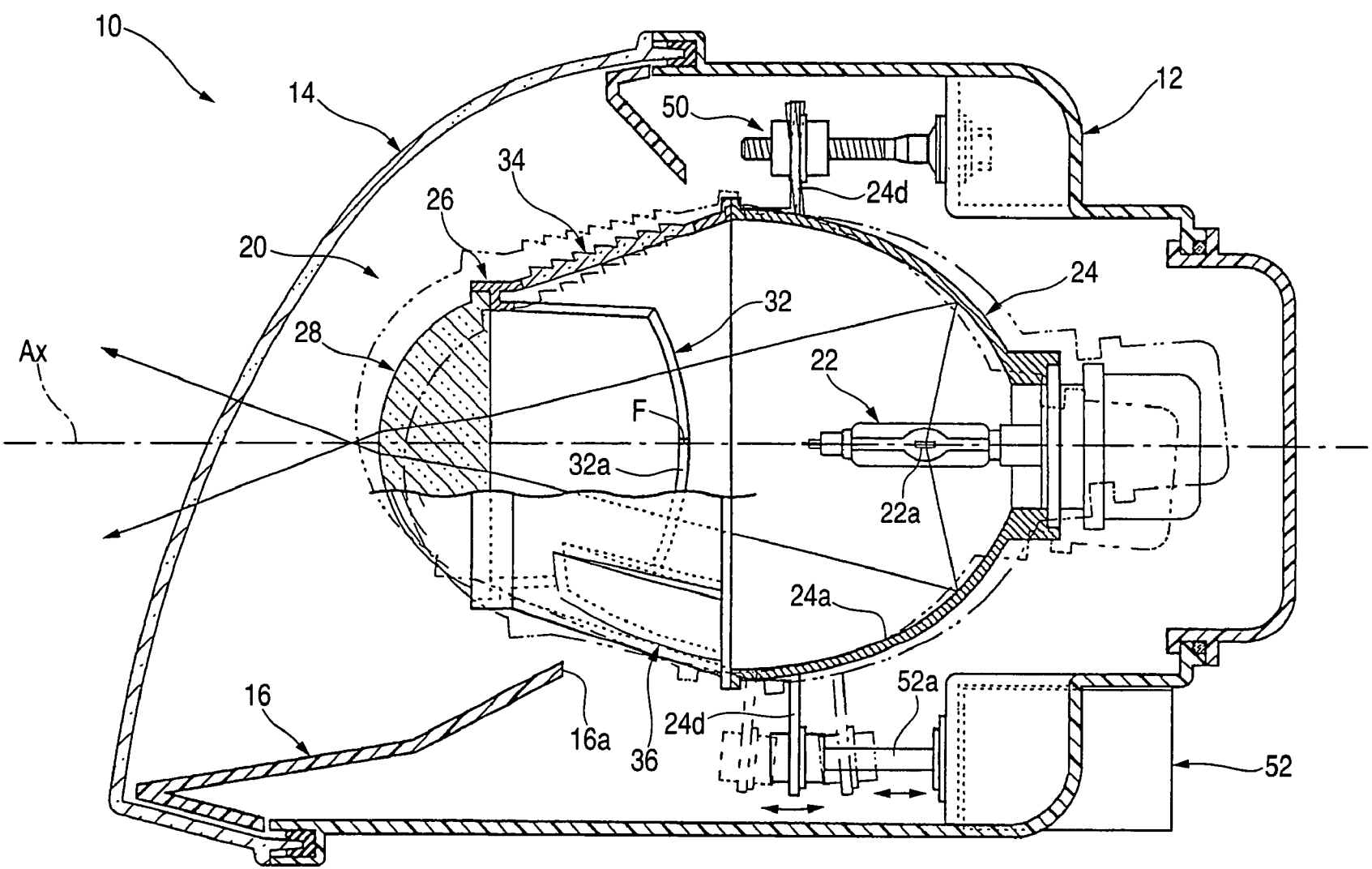
FIG. 2 is a plan cross-sectional view showing the vehicle headlamp according to the exemplary, non-limiting embodiment.

FIG. 1 is a side cross-sectional view showing a headlamp 10 according to an exemplary, non-limiting embodiment; and FIG. 2 is a plan cross-sectional view showing the same. The vehicle headlamp 10 is a lamp disposed at a right front end of a vehicle, and is configured as follows. In a lamp chamber constituted of a lamp body 12 and a clear translucent cover 14 disposed at a front-end opening of the lamp body 12, a lamp unit 20 is housed to allow substantially vertical and lateral tilting by an aiming mechanism 50. The lamp unit 20 has an optical axis Ax extending in a longitudinal direction (e.g., the longitudinal direction of the vehicle, but not limited thereto).

Additionally, the lamp unit 20 is configured such that, upon completion of aiming control by means of the aiming mechanism 50, the optical axis Ax extends in a direction oriented 0.5 to 0.6 degrees downward with respect to the longitudinal direction.

In addition, the aiming mechanism 50 includes a swivel mechanism 52 as shown in FIG. 2. The swivel mechanism 52 includes an actuator, such as a stepping motor attached to the lamp body 12. The swivel mechanism 52 is configured to move an output shaft 52*a* thereof in the longitudinal direction in accordance with e.g., a driving condition of the vehicle, thereby rotationally moving the lamp unit 20 within an angular range a lateral direction as shown by a line having long and short dashes.

The translucent cover 14 wraps rearward from the inside to outside in the widthwise direction of the vehicle along the shape of e.g., the vehicle body of the right corner section in the front end of the vehicle. An extension panel 16 is disposed to extend along the translucent cover 14 in the lamp chamber. An opening 16*a* surrounding the lamp unit 20 in the vicinity of the front end of the lamp unit 20 is formed in the extension panel 16.

Figure 3:
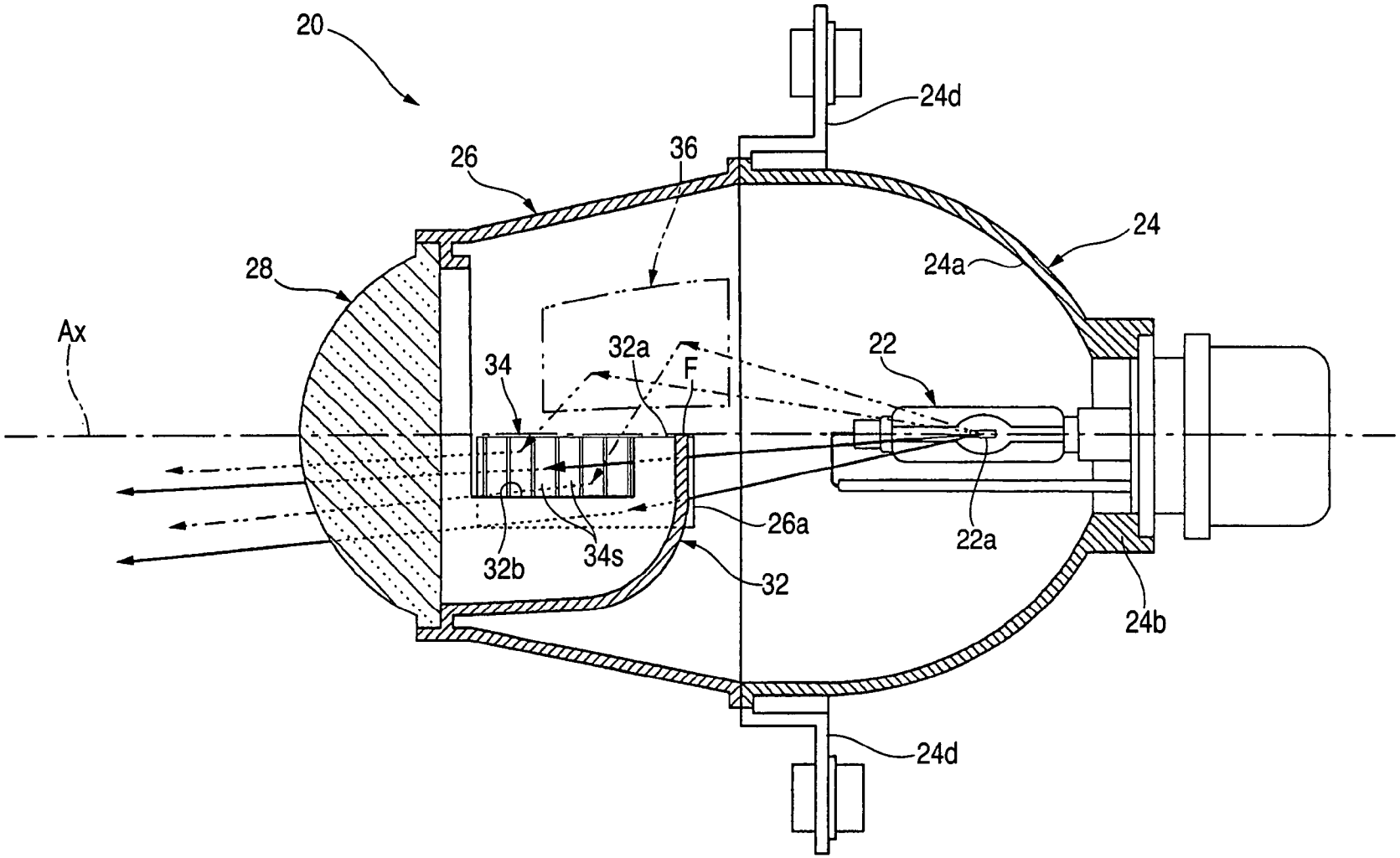
FIG. 3 is a side cross-sectional view showing a lamp unit as a single article according to the exemplary, non-limiting embodiment.
Figure 4:
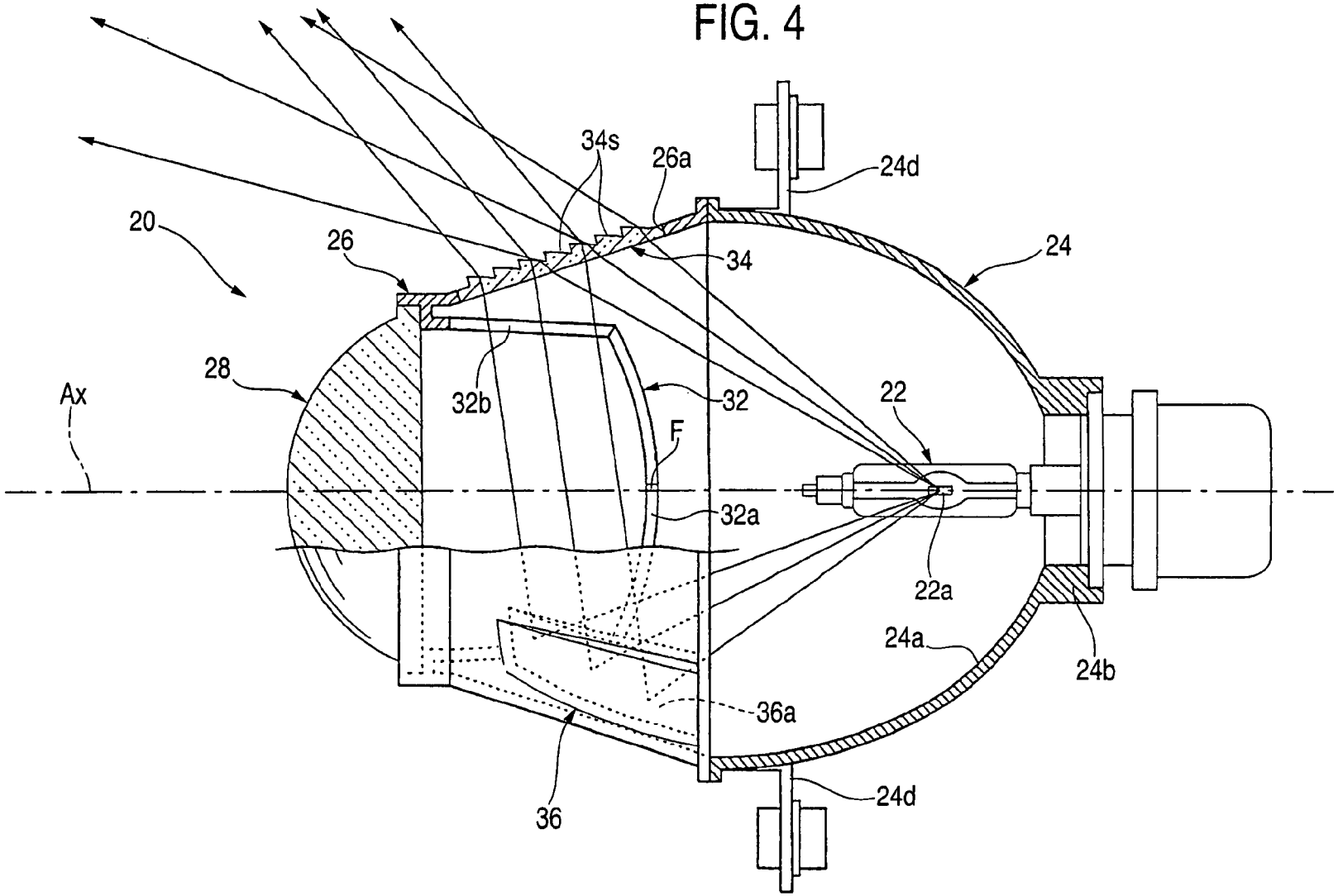
FIG. 4 is a plan cross-sectional view showing the lamp unit as a single article, according to the exemplary, non-limiting embodiment.
Figure 5:
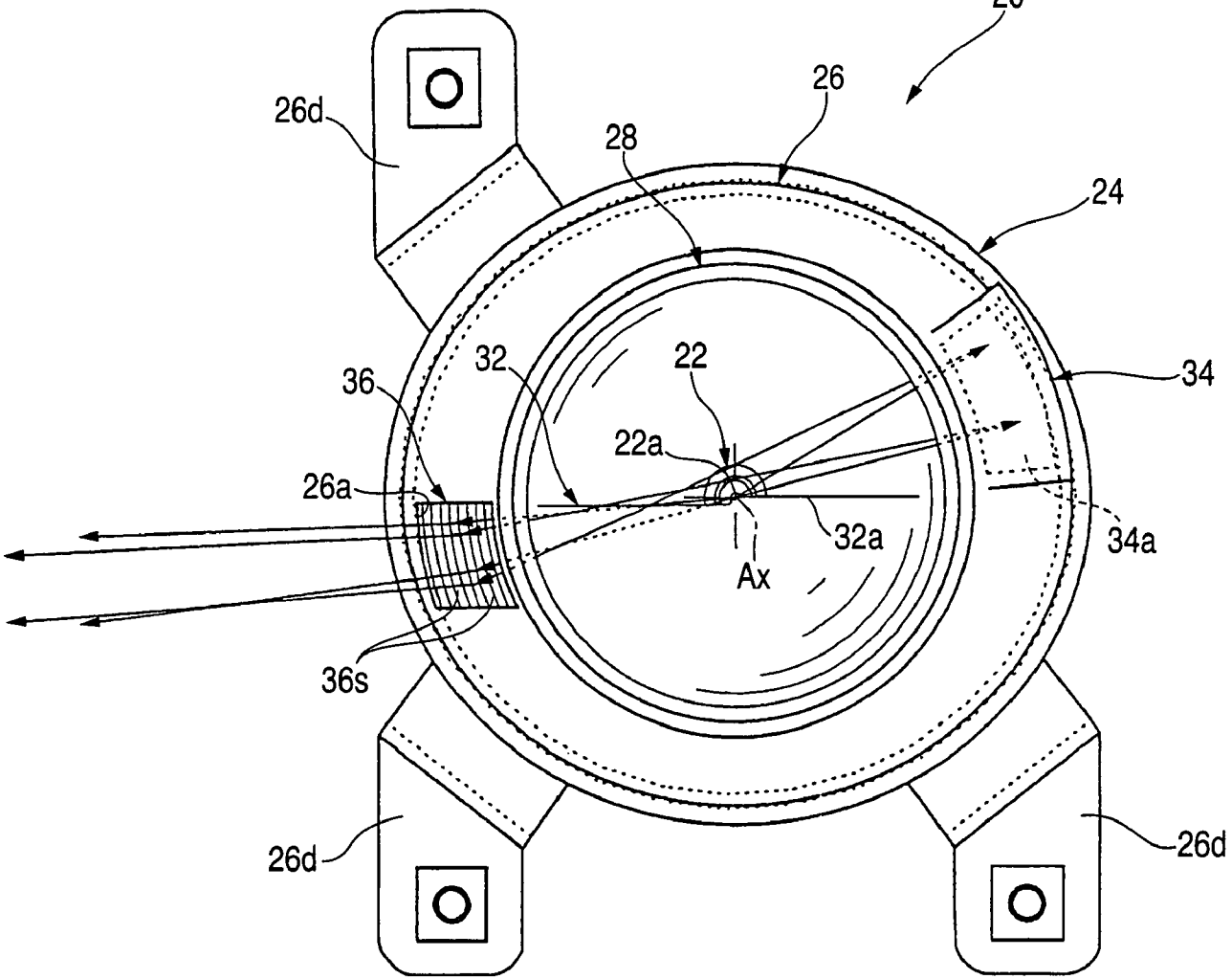
FIG. 5 is a front view showing the lamp unit as a single article, according to the exemplary, non-limiting embodiment.

FIG. 3 is a side cross-sectional view showing the lamp unit 20 as a single article; FIG. 4 is a plan cross-sectional view showing the same; and FIG. 5 is a front view showing the same. The lamp unit 20 is a lamp unit of projector type and comprises a light source bulb 22, a reflector 24, a lens holder 26, a projection lens 28, a shade 32, a prismatic lens 34, and an additional reflector 36.

The projection lens 28 is formed from a plano-convex lens having a substantially convex surface as the front surface and a substantially planar surface as the back surface, and is disposed on the optical axis Ax. The projection lens 28 is configured such that an image on a focal plane including a rear focal point F is projected forward as a reversed image thereof.

The light source bulb 22 is a discharge lamp, such as a metal halide bulb, which employs a discharge light-emitting section as a light source 22*a*. The light source 22*a* is configured as a line segment light source extending parallel to a center axis of the bulb. The light source bulb 22 is fixedly inserted into a back vertex opening 24*b* of the reflector 24 such that the light source 22*a* is disposed on the optical axis Ax and to the rear of the rear focal point F of the projection lens 28.

The reflector 24 has a reflection surface 24*a* for reflecting light from the light source bulb 22 forward and close to the optical axis Ax. The reflection surface 24*a* has a substantially elliptical cross-sectional profile, and is configured such that the eccentricity of the ellipse gradually increases from a vertical cross section toward a horizontal cross section. By virtue of the above configuration, the light, which originated at the light source 22*a* and is reflected by the reflection surface 24*a*, substantially converges in the vicinity of the rear focal point F within the vertical cross sectional plane. The convergence point is displaced forward to a large extent in the horizontal cross sectional plane.

The reflector 24 is supported by the lamp body 12 by way of the aiming mechanism 50 at aiming brackets 24*d* formed at three points on the reflector 24. However, any other supporting structure may be used, as would be known by one of ordinary skill in the art.

The shade 32 is formed integrally with the lens holder 26 so as to be positioned at a substantially lower half section of an interior space of the lens holder 26. The shade 32 is formed such that an upper edge 32*a* thereof passes through the rear focal point F of the projection lens 28. By virtue of the configuration, a portion of light reflected by the reflection surface 24*a* of the reflector 24 is shielded, thereby preventing most of upward light from exiting forward from the projection lens 28. In relation to the above, the upper edge 32*a* of the shade 32 extends substantially horizontally in the form of substantially arc shape along a rear focal plane of the projection lens 28, such that the right-side and left-side of the edge differ in level.

The lens holder 26 extends forward from a front-end opening of the reflector 24 in a substantially cylindrical shape while being slightly tapered. The rear end section of the lens holder 26 is fixedly supported on the reflector 24, and, the front end section of the lens holder 26 fixedly supports the projection lens 28.

A substantially rectangular opening 26*a* is formed in the outside of the circumferential wall of the lens holder 26 in the widthwise orientation. The opening 26*a* is disposed slightly below the optical axis Ax. The prismatic lens 34 is attached to the opening 26*a* in a fitting-in manner. The prismatic lens 34 comprises a plurality of lens elements 34*s* that form a substantially vertical stripe pattern. The prismatic lens 34 is configured to refract the direct light, which has traveled from the light source 22*a* toward the outside of the widthwise direction, so as to approach the optical axis Ax. As a result, light is illuminated forward without passing through the projection lens 28. In relation to the above, the respective lens elements 34*s* are configured to diffuse the direct light from the light source 22*a* in the horizontal direction and to refract the same substantially close to the optical axis Ax.

The additional reflector 36 is disposed inside the circumferential wall of the lens holder 26 in the widthwise orientation. The additional reflector 36 is configured as a portion of the lens holder 26. A reflection surface 36*a* of the additional reflector 36 is formed by deforming a portion of an inner peripheral surface of the lens holder 26 at a position slightly above the optical axis Ax, and applying mirror treatment thereto. The reflection surface 36*a* is formed from a paraboloid of revolution whose focal point is a luminous center of the light source 22*a*. By this configuration, the reflection surface 36*a* reflects the direct light from the light source 22*a* toward the prismatic lens 34 as substantially parallel light.

For allowing incidence of light from the additional reflector 36 to the prismatic lens 34, a notch 32*b* is formed at the upper end of a right wall of the shade 32.

Figure 6:
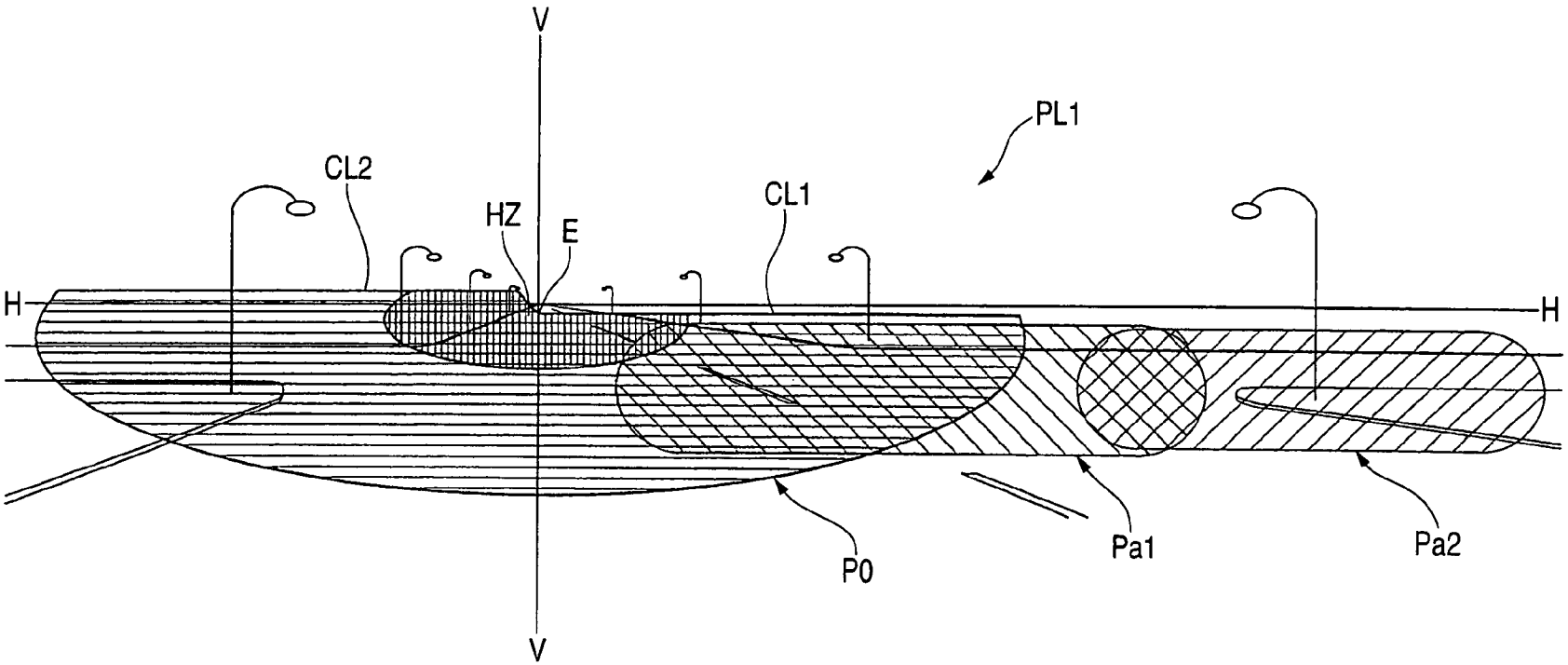
FIG. 6 is a perspective view showing a low-beam light distribution pattern formed from light illuminated forward from the headlamp on a virtual screen placed ahead of the lamp.

FIG. 6 is a perspective view showing a low-beam light distribution pattern formed from light illuminated forward from the vehicle headlamp 10 on a virtual vertical screen placed at a position about 25 m ahead of the lamp. The low-beam light distribution pattern PL1 is a left-oriented low-beam light distribution pattern. The pattern PL1 has, at an upper edge thereof, cutoff lines CL1 and CL2 which differ in level on the right and the left sides thereof. The cutoff lines CL1 and CL2 extend substantially horizontally so as to differ in level on the right and the left sides with a line V-V vertically passing through a point H-V therebetween. The point H-V is a vanishing point in the front direction of the lamp.

Of the cutoff lines, the portion to the right of the line V-V and corresponding to the opposite lane is formed as the lower cutoff line CL1, and the portion on the left of the line V-V and corresponding to the vehicle's own lane is formed as the upper cutoff line CL2. The upper cutoff line CL2 is stepped-ascended from the lower cutoff line CL1 with a sloped section therebetween. In the low-beam light distribution pattern PL1, a position of an elbow point E, which is an intersection of the lower cutoff line CL1 and the line V—V, is formed at a location situated about 0.5 to 0.6 degrees below the point H-V. A hot zone HZ, which is a high-intensity region, is formed to surround the elbow point E.

The low-beam light distribution pattern PL1 is formed as a composite light distribution pattern of a basic light distribution pattern P0 and additional light distribution patterns Pa1 and Pa2.

The basic light distribution pattern P0 is a light distribution pattern forming a base shape of the low-beam light distribution pattern PL1. The basic light distribution pattern P0 is formed from light illuminated from the light source 22*a*, reflected by the reflector 24, and passed through the projection lens 28. More specifically, the basic light distribution pattern P0 is formed by means of projecting an image from light emitted by the light source 22*a*—formed on the rear focal plane of the projection lens 28 from light illuminated from the light source 22*a* and reflected by the reflection surface 24*a* of the reflector 24—on the virtual vertical screen as a reverse projection image thereof. The cutoff lines CL1 and CL2 are formed as reversed projection images of the upper edge 32*a* of the shade 32.

Meanwhile, the additional light distribution pattern Pa1 is a light distribution pattern additionally formed for the purpose of enhancing the right diffusion region of the basic light distribution pattern P0 and spreading the low-beam light distribution pattern PL1 to the right to make it wider than the basic light distribution pattern P0. The additional light distribution pattern Pa1 is formed from the direct light illuminated from the light source 22*a* by way of the prismatic lens 34.

The respective lens elements 34*s* constituting the prismatic lens 34 are configured to diffuse the direct light from the light source 22*a* in the horizontal direction in addition to refracting the same close to the optical axis Ax. Therefore, the additional light distribution pattern Pa1 is formed as a horizontally-elongated light distribution pattern. In addition, since the prismatic lens 34 is disposed slightly below the optical axis Ax, the additional light distribution pattern Pa1 is formed such that the upper edge thereof is slightly below the lower cutoff line CL1.

Meanwhile, the additional light distribution pattern Pa2 is a light distribution pattern formed for enhancing the right diffusion region of the additional light distribution pattern Pa1 and spreading the low-beam light distribution pattern PL1 to the right to make it wider than the basic light distribution pattern P0 and the additional light distribution pattern Pa1. The additional light distribution pattern Pa2 is formed from light reflected by the additional reflector 36 and illuminated forward by the prismatic lens 34.

The additional light distribution pattern Pa2 is also formed as a horizontally-elongated light distribution pattern. However, since the light reflected by the additional reflector 36 is incident to the prismatic lens 34 as substantially parallel light, the diffusion angle of the reflected light in the horizontal direction is smaller than that of the additional light distribution pattern Pa1. In addition, since the additional reflector 36 is slightly above the optical axis Ax, the additional light distribution pattern Pa2 is formed such that the upper edge thereof is slightly below the lower cutoff line CL1.

As described above in detail, the vehicle headlamp 10 according to the exemplary, non-limiting embodiment is configured so that the reflector 24 of the lamp unit 20 reflects light from the light source 22*a* which is disposed to the rear of the rear focal point of the projection lens 28 forward and close to the optical axis Ax, and a portion of light reflected by the reflector 24 is shielded by the shade 32 disposed in the vicinity of the rear focal point F. Accordingly, the basic light distribution pattern P0, which serves as the low-beam light distribution pattern, can be formed from the light that has originated from the light source 22*a*, has been reflected by the reflector 24, and has passed through the projection lens 28.

In relation to the above, at a position between the projection lens 28 and the reflector 24 and outwardly separated from the optical axis Ax in the widthwise direction of the vehicle, there is disposed the prismatic lens 34 for refracting the light, which has traveled from the light source 22*a* toward the outside of the widthwise direction of the vehicle, to become closer to the optical axis Ax without allowing the light to pass through the projection lens 28. By this configuration, from light having exited from the prismatic lens 34, the additional light distribution pattern Pa1 can be formed substantially outside in the widthwise orientation of the basic light distribution pattern P0 formed from the light that has originated from the light source 22*a*, has been reflected by the reflector 24, and has passed through the projection lens 28.

The additional reflector 36 for reflecting the direct light, which traveled from the light source 22*a* toward the inside of the widthwise orientation, toward the prismatic lens 34 is disposed at a position inwardly separated from the optical axis Ax in the widthwise direction of the vehicle between the projection lens 28 and the reflector 24. Accordingly, the second additional light distribution pattern Pa2 can be formed from the light that has originated from the light source 22*a*, has been reflected by the additional reflector 36, and has passed through the prismatic lens 34. In relation to the above, the light reflected by the additional reflector 36 and oriented toward the prismatic lens 34 has a larger divergence angle outward in the widthwise direction of the vehicle with respect to the optical axis Ax. Consequently, the additional light distribution pattern Pa2 is formed outside of the additional light distribution pattern Pa1 in the widthwise direction of the vehicle.

By means of forming the additional light distribution patterns Pa1 and Pa2 in addition to the basic light distribution pattern P0 as described above, luminous energy of the low-beam light distribution pattern PL1 can be increased.

In addition, the additional light distribution pattern Pa1 is formed outside of the basic light distribution pattern P0 in the widthwise direction of the vehicle, and the additional light distribution pattern Pa2 is formed outside of the additional light distribution pattern Pa1 in the widthwise direction of the vehicle. As a result, visibility of the road in the rightward oblique direction, ahead of the vehicle, can be enhanced without causing a driver of an oncoming vehicle or others to experience glare.

As described above, according to the present exemplary, non-limiting embodiment, luminous energy of the low-beam light distribution pattern PL1 can be increased without hindering formation of the pattern. As a result, forward visibility of the vehicle at a time of vehicle cornering is enhanced, thereby enhancing safety in driving of the vehicle.

In addition, the lamp unit 20 of the embodiment includes the prismatic lens 34 constituted of the plurality of lens elements 34*s*. Accordingly, light deflection control can be performed with high accuracy while maintaining the substantially uniform thickness of the prismatic lens 34.

In addition, in the lamp unit 20, the prismatic lens 34 is disposed below the optical axis Ax, and the additional reflector 36 is disposed above the optical axis Ax. Accordingly, without controlling vertical optical deflection by the prismatic lens, upward-illuminating light can be prevented from exiting from the prismatic lens 34 to protect a driver of an oncoming vehicle or others from experiencing glare. As a result, the configuration of the prismatic lens 34 can be simplified.

In particular, in the embodiment, the prismatic lens 34 is disposed slightly below the optical axis Ax, and the additional reflector 36 is disposed slightly above the optical axis Ax. Accordingly, the additional light distribution patterns Pa1 and Pa2 can be formed so that the upper edges thereof are slightly below the lower cutoff line CL1. As a result, forward visibility at the time of vehicle cornering and the like can be further enhanced. Furthermore, the respective lens elements 34*s* constituting the prismatic lens 34 are configured to diffuse the direct light from the light source 22*a* in the horizontal direction in addition to causing the same to refract close to the optical axis Ax. Accordingly, the additional light distribution patterns Pa1 and Pa2 can be horizontally-elongated light distribution patterns. As a result, since the road in the rightward (or leftward) oblique direction, ahead of the vehicle, can be illuminated wide, forward visibility can be enhanced.

Furthermore, in the exemplary, non-limiting embodiment, the projection lens 28 is fixed to the reflector 24 by the substantially cylindrical lens holder 26, the prismatic lens 34 is attached to the opening 26*a* formed in a circumferential wall of the lens holder 26, and the additional reflector 36 is configured as a portion of the lens holder 26. Accordingly, positional accuracies of the prismatic lens 34 and the additional reflector 36 can be increased, and the configuration of the lamp unit 20 can be simplified. In addition, since the lamp unit 20 can be configured compact, despite the lamp unit 20 being configured to be capable of swiveling, the lamp can be configured compact as a whole, similar to the vehicle headlamp 10.

Figure 7:
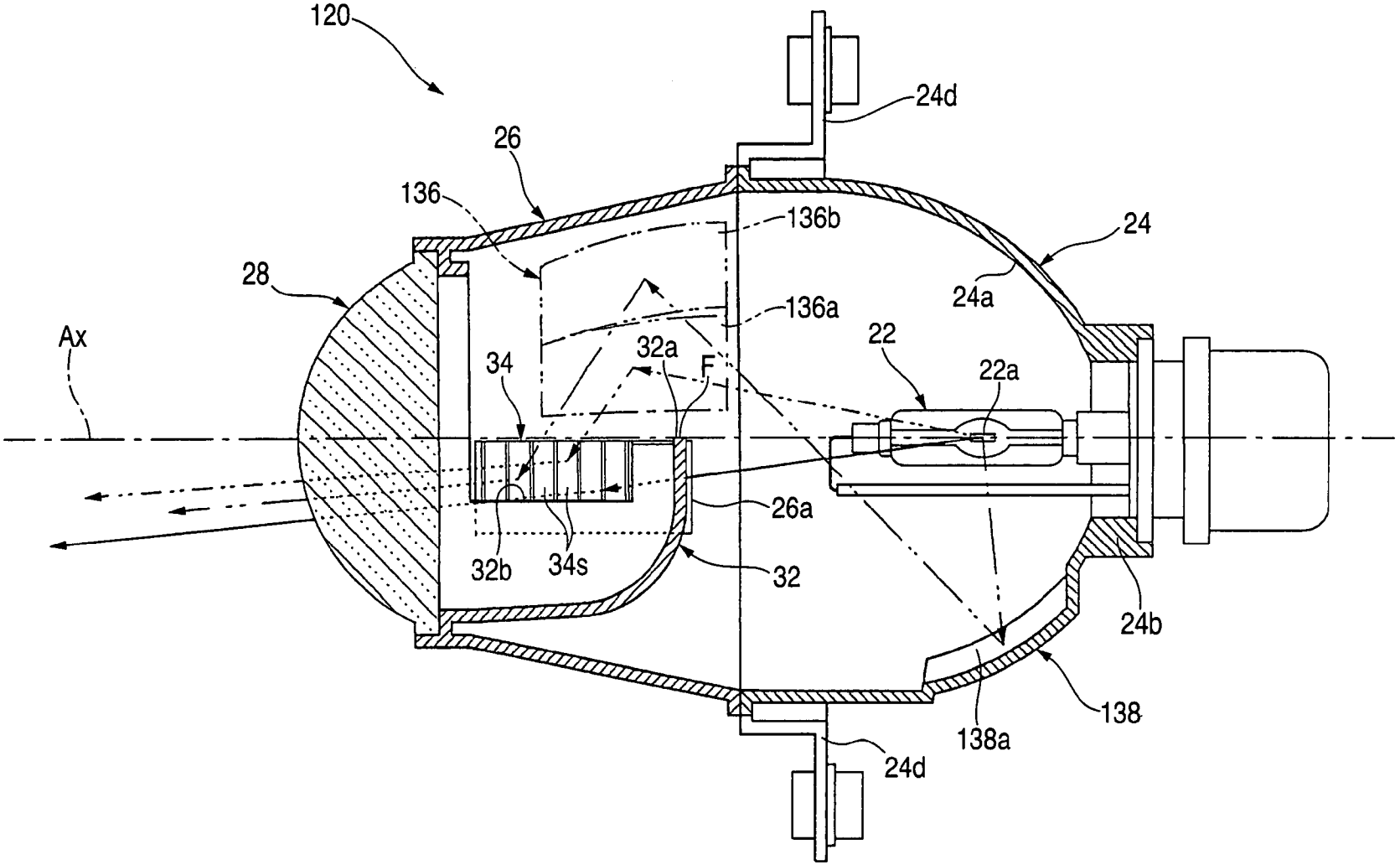
FIG. 7 is a view, similar to FIG. 3, showing a modification of the exemplary, non-limiting embodiment.
Figure 8:
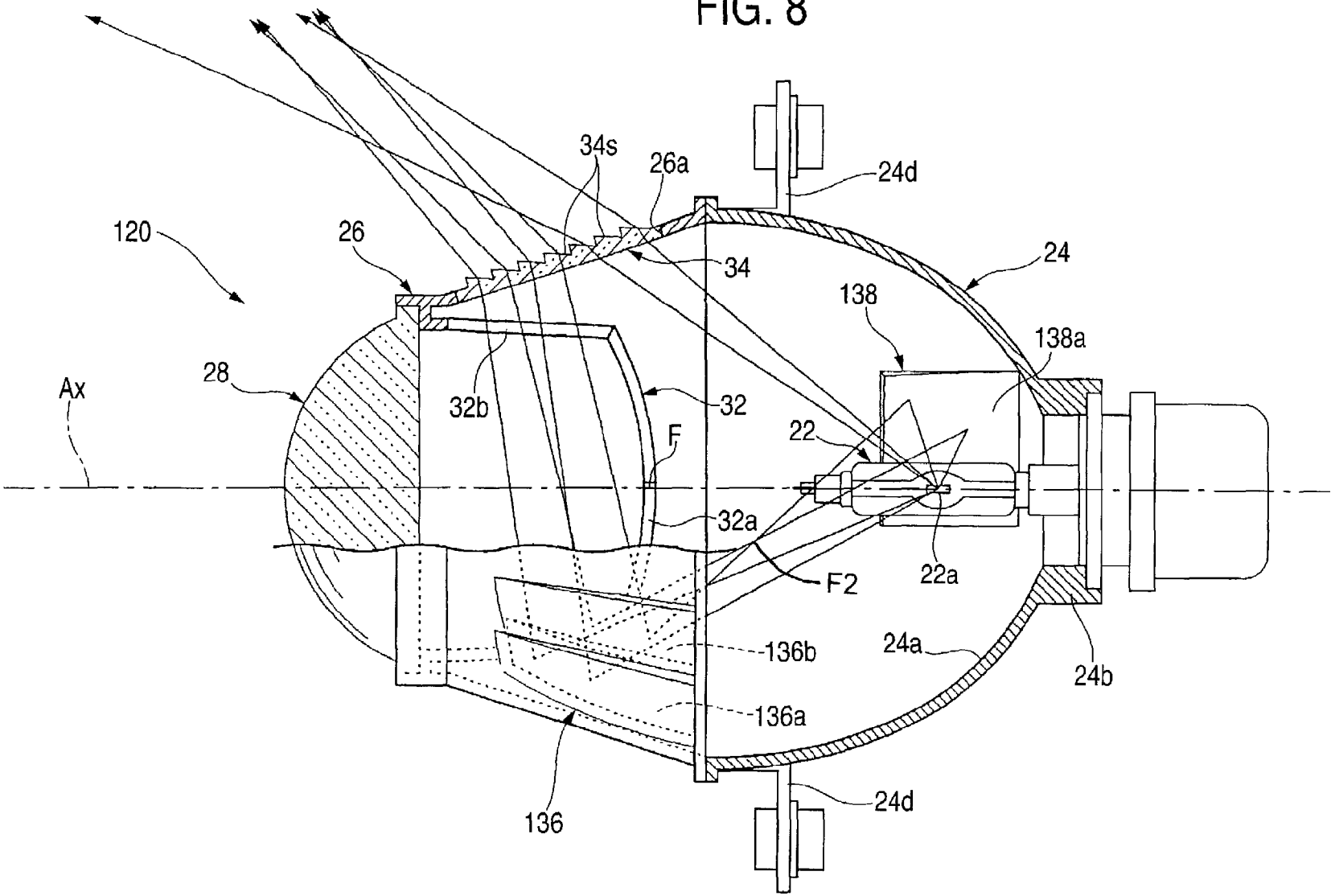
FIG. 8 is a view, similar to FIG. 4, showing the modification of the exemplary, non-limiting embodiment.

Next, a modification of the embodiment will be described. FIG. 7 is a side cross-sectional view showing a lamp unit 120 of a vehicle headlamp according to the modification as a single article. FIG. 8 is a plan cross-sectional view showing the same.

The lamp unit 120 of the modification has the same basic configuration with that of the lamp unit 20. However, the lamp unit 120 differs from the lamp unit 20 in that the configuration of an additional reflector 136 differs from that of the additional reflector 36 of the lamp unit 20, and that the lamp unit 120 has a second additional reflector 138.

The additional reflector 136 has two reflection surfaces, including a reflection surface 136*a* and a reflection surface 136*b*, disposed in two layers arranged vertically. The lower reflection surface 136*a* reflects the direct light from the light source 22*a* toward the prismatic lens 34 as in the case of the reflection surface 36*a* of the additional reflector 36.

The second additional reflector 138 is disposed below the light source 22*a*. In relation to the above, the additional reflector 138 is formed by partially deforming the reflector 24, to thereby be configured as a portion of the reflector 24. The additional reflector 138 reflects the direct light from the light source 22*a* toward the upper reflection surface 136*b*. A reflection surface 138*a* of the additional reflector 138 is fanned from a spheroid whose first focal point F2 is at a luminescence center of the light source 22*a* and whose second focal point is at a point between the luminescence center and the reflection surface 136*b*. By this configuration, the direct light from the light source 22*a* is reflected by the reflection surface 138*a*, to thus be converged once, and is thereafter brought incident to the upper-layer reflection surface 136*b*.

The upper reflection surface 136*b* of the additional reflector 136 is formed from a paraboloid of revolution whose focal point is the second focal point F2 of the spheroid constituting the reflection surface 138*a* of the additional reflector 138. By this configuration, the reflection surface 136*b* reflects light reflected by reflection surface 138*a* toward the prismatic lens 34 as substantially parallel light.

Figure 9:
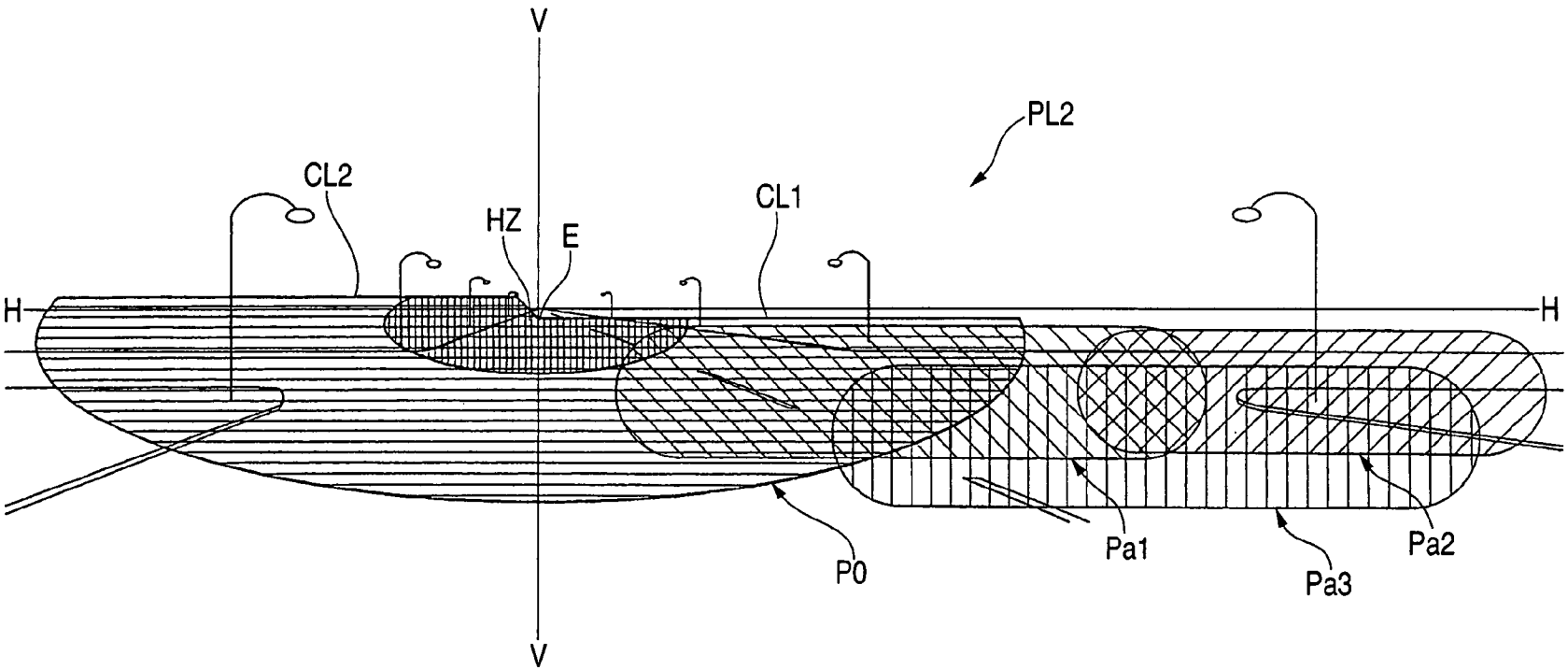
FIG. 9 is a view, similar to FIG. 6, showing effects of the modification.

FIG. 9 is a perspective view showing a low-beam light distribution pattern formed from light illuminated forward from a vehicle headlamp including the lamp unit 120 on a virtual vertical screen placed at a position about 25 m ahead of the lamp.

The low-beam light distribution pattern PL2 is formed as a composite light distribution pattern consisting of a basic light distribution pattern P0 and additional light distribution patterns Pa1, Pa2, and Pa3.

The basic light distribution pattern P0 and additional light distribution patterns Pa1 and Pa2 are substantially identical with those of the low-beam light distribution pattern PL1.

The third additional light distribution pattern Pa3 is a light distribution pattern additionally formed for the purpose of enhancing brightness of the additional light distribution patterns Pa1 and Pa2. The additional light distribution pattern Pa3 is formed from light reflected by the additional reflector 138 and illuminated forward by way of the additional reflector 136 and the prismatic lens 34. The additional light distribution pattern Pa3 is formed, in the additional reflector 136, by light reflected by the reflection surface 136*b* upwardly adjacent to the reflection surface 136*a* for forming the additional light distribution pattern Pa2. Accordingly, the additional light distribution pattern Pa3 is located below the additional light distribution pattern Pa2.

When the configuration of the modification is adopted, brightness outside of the basic light distribution pattern P0 in the widthwise direction of the vehicle can be further enhanced while maintaining the configuration of the lamp unit 120 compact. As a result, visibility of the road in the rightward oblique direction, ahead of the vehicle, can be further enhanced.

Meanwhile, the above embodiment and modification have described a case where the lamp unit 20, 120 is a lamp unit for a vehicle headlamp on the right side of the vehicle. However, also in a case of the lamp unit for a left-side vehicle headlamp, when the prismatic lens 34 and the additional reflector 36, 136, 138 are disposed laterally symmetric with respect to the lamp unit 20, 120, visibility of the road in the leftward oblique direction, ahead of the vehicle, can be enhanced, thereby enhancing safety in driving at a time of vehicle cornering to the left.

While the invention has been described above with reference to the embodiment, the technical range of the invention is not restricted to the range described in the embodiment. It is apparent to the skilled in the art that various changes or improvements can be made in the embodiment. It is apparent from the appended claims that the embodiment thus changed or improved can also be included in the technical range of the invention.

The invention claimed is:

1. A headlamp configured to illuminate light for forming a low-beam light distribution pattern, comprising:

a projection lens disposed on an optical axis extending in a longitudinal direction of a vehicle and having a rear focal point;

a light source disposed rear of said rear focal point;

a first reflector that reflects light from the light source forward and toward the optical axis:

a shade disposed near the rear focal point such that an upper edge of the shade is near the optical axis, and shields a portion of light reflected by the first reflector;

a prismatic lens that receives direct light from the light source and reflected light from a second reflector, the prismatic lens facing outwardly with respect to the optical axis and being provided between the projection lens and the first reflector: and the second reflector that receives direct light from the light source, the second reflector facing toward the optical axis wherein the second reflector reflects the received direct light toward the prismatic lens, the second reflector is provided between the projection lens and the first reflector, and the second reflector is provided at an opposite side of the optical axis with respect to the prismatic lens in the widthwise direction of a vehicle.

2. The headlamp according to claim 1, wherein the prismatic lens comprises a plurality of lens elements.

3. The headlamp according to claim 1, wherein the prismatic lens is below the optical axis, and the second reflector is above the optical axis.

4. The vehicle headlamp according to claim 1, wherein the projection lens is fixed to the reflector by a substantially cylindrical lens holder, the prismatic lens is attached to an opening in a circumferential wall of the lens holder, and the second reflector is a portion of the lens holder.

5. The vehicle headlamp according to claim 1, further comprising a third reflector disposed below the light source, the third reflector reflecting direct light from the light source toward the second reflector.

6. A headlamp having an optical axis extending in a first direction, comprising:

a headlamp body;

a cover disposed at an opening of the lamp body to form a lamp chamber therein; and a lamp unit positioned in the lamp chamber, comprising, a first reflector having a reflection surface that reflects light from a light source forward and toward the optical axis, a lens holder extending forward from an opening of the first reflector, a projection lens disposed on the optical axis and forward of a rear focal point of the projection lens, a shade formed integrally with the lens holder at a substantially lower half section of an interior space of the lens holder, a prismatic lens attached to a side opening of the lens holder and being provided at an outside of a circumferential wall of the lens holder, and a second reflector provided at an inside of the circumferential wall of the lens holder, wherein the second reflector reflects light from the light source toward the prismatic lens, and being provided at an opposite side of the optical axis with respect to the prismatic lens in the widthwise direction of a vehicle.

7. The headlamp of claim 6, wherein the projection lens is configured such that an image on a focal plane including a rear focal point is projected forward as a reversed image thereof.

8. The headlamp of claim 6, wherein the light source is a discharge lamp having a discharge light-emitting section, which extends substantially parallel to a center axis of a bulb, and is disposed on the optical axis and to the rear of a rear focal point of the projection lens.

9. The headlamp of claim 6, wherein the reflection surface has a substantially elliptical cross-sectional profile and an eccentricity that increases from a vertical cross section toward a horizontal cross section.

10. The headlamp of claim 6, wherein an upper edge of the shade passes through a rear focal point of the projection lens and extends substantially horizontally in a substantially arc shape along a rear focal plane of the projection lens, to shield light reflected by the reflection surface.

11. The headlamp of claim 6, wherein the prismatic lens comprises a plurality of lens elements in a substantially vertical stripe pattern, the pattern configured to receive direct light, which has been transmitted from the light source outwardly with respect to a widthwise direction of a vehicle, and to refract the received light toward the optical axis.

12. The headlamp of claim 6, wherein the second reflector is a portion of the lens holder and comprises a paraboloid of revolution having a focal point as a luminous center of the light source.

13. The headlamp of claim 6, wherein a notch is formed at an upper end of a side wall of the shade.

14. The headlamp of claim 6, wherein the projection lens is fixed to the first reflector by a substantially cylindrical lens holder, the prismatic lens is attached to the opening formed in a circumferential wall of the lens holder, and the second reflector is a portion of the lens holder.

15. The headlamp of claim 6, wherein the second reflector has a first lower reflection surface and a second upper reflection surface, arranged vertically, and further comprising a third reflector disposed below the light source.

16. The headlamp of claim 15, wherein a portion of the first reflector is partially deformed, the third reflector reflects the direct light from the light source toward the second upper reflection surface, and a third reflection surface on the third reflector is a spheroid having a first focal point at a luminescence center of the light source and a second focal point between the luminescence center and the second upper reflection surface.

17. The headlamp of claim 15, wherein the direct light from the light source is reflected by the third reflection surface and incident to the second reflection surface.

18. The headlamp of claim 16, wherein the second upper reflection surface is a paraboloid of revolution having a focal point that is the second focal point of the spheroid comprising the reflection surface of the third reflector, and the second reflection surface reflects light reflected by a third reflection surface of the third reflector toward the prismatic lens as substantially parallel light.

* * * * *